US006401275B1

(12) United States Patent
Garner

(10) Patent No.: US 6,401,275 B1
(45) Date of Patent: Jun. 11, 2002

(54) SINK BACKSPLASH

(75) Inventor: Robert A. Garner, Hopkins, SC (US)

(73) Assignee: G&A Enterprises, L.L.C., Columbia, SC (US)

( * ) Notice: Subject to any disclaimer, the term of this patent is extended or adjusted under 35 U.S.C. 154(b) by 0 days.

(21) Appl. No.: 09/680,596

(22) Filed: Oct. 6, 2000

(51) Int. Cl.[7] ..... A47J 47/20; E03C 1/12
(52) U.S. Cl. ..... 4/658; 52/34
(58) Field of Search ..... 4/658, 647, 648, 4/643, 654, 660, 649, 631, 628; 52/34, 35; 312/228, 228.1; D23/270, 284, 292, 307, 308

(56) References Cited

U.S. PATENT DOCUMENTS

| | | | | | |
|---|---|---|---|---|---|
| 917,454 | A | | 4/1909 | Kelly | |
| 1,104,792 | A | | 7/1914 | Gray | |
| 1,221,137 | A | | 4/1917 | Carney | |
| 1,385,262 | A | | 7/1921 | Nebel | |
| 1,618,032 | A | | 2/1927 | Wilkes | |
| 1,901,151 | A | | 3/1933 | Druckenmiller | |
| 1,922,345 | A | * | 8/1933 | Bauch | 4/628 |
| 2,293,184 | A | | 8/1942 | Weissert | |
| 2,361,604 | A | * | 10/1944 | Coordes | 4/647 |
| 2,392,918 | A | | 1/1946 | Haberstump | |
| 2,426,152 | A | | 8/1947 | Meldahl | |
| 2,499,896 | A | * | 3/1950 | Wilson | |
| 2,614,014 | A | | 10/1952 | Stantitz | |
| 2,855,259 | A | * | 10/1958 | Raschke | |
| 2,890,919 | A | * | 6/1959 | Hansen | |
| 2,895,778 | A | | 7/1959 | Lieber | |
| 3,130,420 | A | | 4/1964 | Colucci | |
| 3,440,670 | A | * | 4/1969 | Van Hoof | 4/648 |
| 3,514,577 | A | | 5/1970 | Dills et al. | |
| 4,674,139 | A | * | 6/1987 | Walker | 4/643 |
| 5,260,007 | A | | 11/1993 | Efstratis et al. | |
| 5,546,708 | A | | 8/1996 | Efstratis et al. | |
| 5,826,396 | A | | 10/1998 | Michaels | |

FOREIGN PATENT DOCUMENTS

| | | | | |
|---|---|---|---|---|
| GB | 257 166 A | * | 8/1926 | 4/658 |
| GB | 2 057 868 A | * | 4/1981 | 4/647 |

* cited by examiner

*Primary Examiner*—Charles R. Eloshway
(74) *Attorney, Agent, or Firm*—William Y. Klett, III; Michael A. Mann; Nexsen Pruet Jacobs & Pollard, LLC

(57) ABSTRACT

An improved backsplash for use with a pedestal, console, or wall basin sink wherein a pre-cut backsplash is inserted between the bowl of a sink and the wall. The backsplash made be made of any number of materials commonly known in the art, such as wood, plastic, porcelain, marble or granite. The backsplash may be finished in any number of colors, textures, or finishes to complement the sink, and may include a fanciful top edge, or integrated soap dish, cup or toothbrush holder, and mirror.

13 Claims, 3 Drawing Sheets

SINK BACKSPLASH

FIELD OF THE INVENTION

The present invention relates generally to an improved backsplash or splash board for a sink and, more particularly, to a backsplash that may be easily attached to either existing pedestal, console or wall basin sinks or to such sinks during initial installation thereof.

BACKGROUND OF THE INVENTION

The use of a backsplash for protection of a wall behind a sink is well known in the art. Backsplashes prevent water damage to the wall on which a sink is mounted, as the likelihood of exposure to water is extremely high every time the sink is used. Such conditions lead to the deterioration of the wall and potentially unsanitary conditions due to moisture.

Sink backsplashes are installed at the time of construction of the sink. Such a backsplash is usually either an integral part of a sink and cabinet system, or is installed at the joint where a sink intersects with a wall using furring board or mounting the backsplash on the wall or top edge of the sink. Such backsplashes are usually made of the same material as the sink or counter top material surrounding the sink, and often require installation by a craftsman skilled in cabinetry or the application of tile.

One style of sink commonly found in bathrooms in traditional homes, including especially renovated homes, is a pedestal sink. A pedestal sink appears as a sink bowl attached to a wall and supported by a narrow pedestal or column, with no cabinetry underneath the sink. Further, because of the configuration of the sink bowl of a pedestal sink, there is no counter space surrounding the sink. Due to this configuration, there is no easy, convenient, or efficient way to attach a backsplash to a pedestal sink because of the way the sink "floats" on its pedestal. Although some pedestal sinks have been made with integral backsplashes, most have no backsplash and backsplashes are not commonly provided with pedestal sinks. These characteristics are also seen in console and wall basin sinks, which also lack cabinetry underneath and counter space around the sink bowl, and likewise have no easy means of attaching a backsplash.

SUMMARY OF THE INVENTION

The present invention is directed to an improved backsplash for use with a pedestal, console, or wall basin sink. The invention comprises a pre-cut backsplash made of any number of materials commonly known in the art, such as wood, plastic, porcelain, marble or granite. The backsplash may be finished in any number of colors, textures, or finishes to complement the sink, and may include a fanciful top edge, or integrated soap dish, cup or toothbrush holder, and mirror.

According to the invention, the backsplash, at its bottom edge, contains two longitudinal apertures or slots which extend perpendicularly from the bottom edge into the backsplash. The backsplash is affixed to the sink by sliding the backsplash parallel to and between the wall and the back of the sink basin. The sink is fastened to the wall through use of two fastening members, most commonly bolts or wall anchors. The longitudinal slots in the backsplash allow the backsplash to extend downward into the space between sink and wall with no interference from the wall fasteners, the slots in the backsplash fitting around the wall fasteners.

According to a further aspect of the invention, the backsplash may be easily attached to a sink during the initial installation of such sink, or the backsplash may be installed to enhance an existing pedestal, console or wall basin sink. The backsplash of the present invention can also be easily removed and replaced with a backsplash of different design or color, if so desired, with no damage the sink or wall on which the sink is mounted.

BRIEF DESCRIPTION OF THE DRAWINGS

Preferred embodiments of the invention are shown in the drawings wherein.

DETAILED DESCRIPTION OF THE PREFERRED EMBODIMENTS

Referring specifically to the drawings, the improved sink backsplash will be disclosed.

Figure 1:
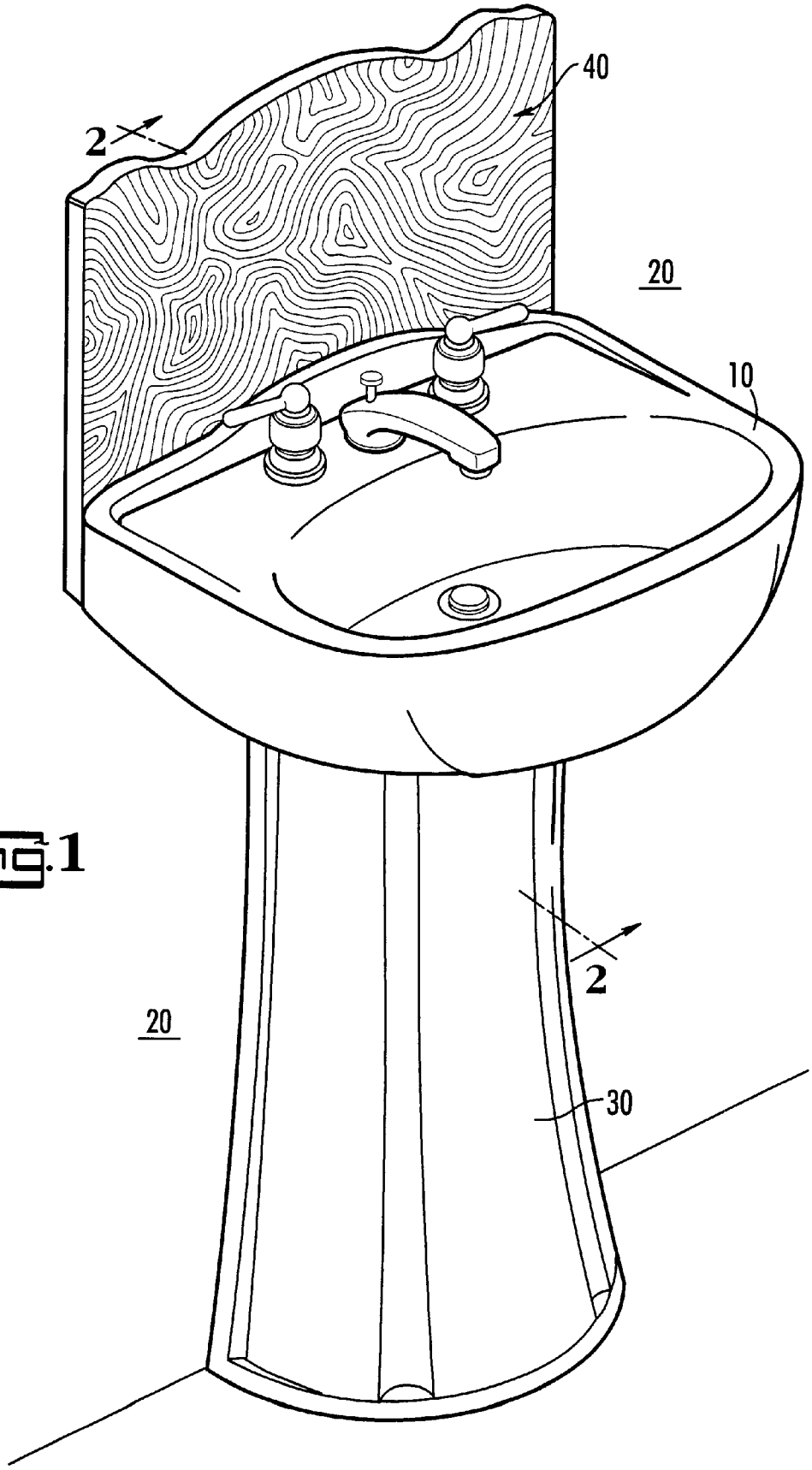
FIG. 1 is a perspective view of the backsplash installed behind a pedestal sink.

The present invention is best suited for use with a pedestal sink as shown in FIG. 1. A pedestal sink comprises a sink bowl (10) having a planar edge (12). Planar edge (12) contains a plurality of apertures (14) extending through planar edge (12). Sink bowl (10) is mounted on a vertical wall (20) at planar edge (12) and supported by a columnar structure or pedestal (30). The backsplash (40) is mounted parallel to and in contact with vertical wall (20) between vertical wall (20) and planar edge (12) of sink bowl (10).

Figure 2:
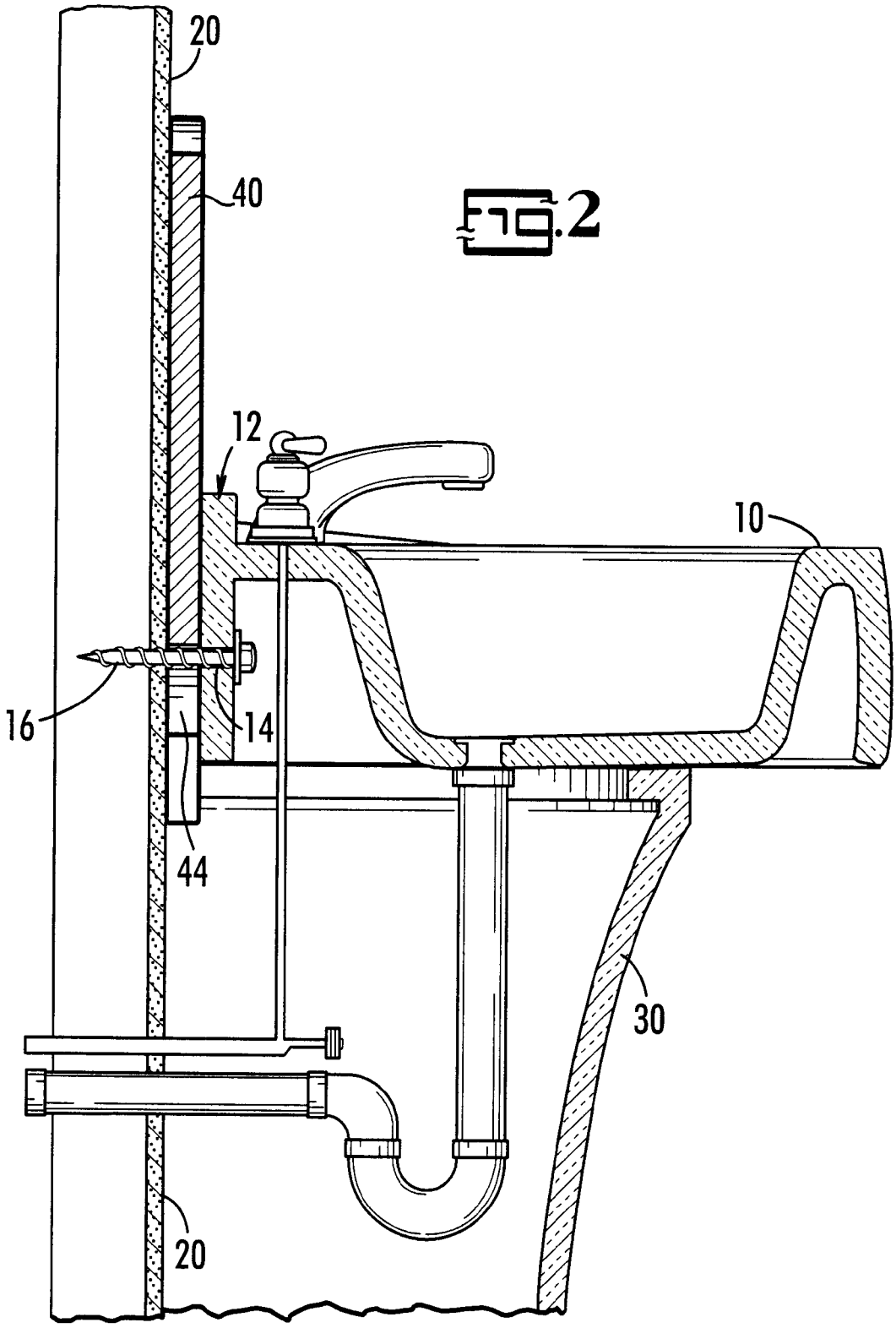
FIG. 2 is a cross-sectional view along line 2—2 showing placement of the backsplash between a pedestal sink and a wall upon which the sink is mounted.

FIG. 2 is a cross-sectional view illustrating the means by which the present backsplash invention is attached to a pedestal sink assembly. The sink bowl (10) is mounted on vertical wall (20) through the use of a plurality of fastening members (16) which extend through apertures (14) and into vertical wall (20). Fastening members (16) are common screws or bolts well-known in the art and used with existing pedestal sink assemblies. The present invention allows backsplash (40) to be inserted between vertical wall (20) and planar edge (12) of sink bowl (10). This may be accomplished without the need to completely remove sink bowl (10) from vertical wall (20) in a novel fashion. Fastening members (16) need only be loosened to the extent necessary to allow sufficient space between vertical wall (20) and planar edge (12) of sink bowl (10) for the insertion of backsplash (40). Fastening members (16) may then be tightened to secure backsplash (40) in place. There is no need with the present invention to disassemble the pedestal sink or its attached plumbing. There is often no need for use of adhesives or additional fastening means to mount backsplash (40) to the pedestal sink assembly. If, however, fastening members (16) is not long enough, given the additional distance to wall 20, longer fastening members (16) can be substituted.

Figure 3:
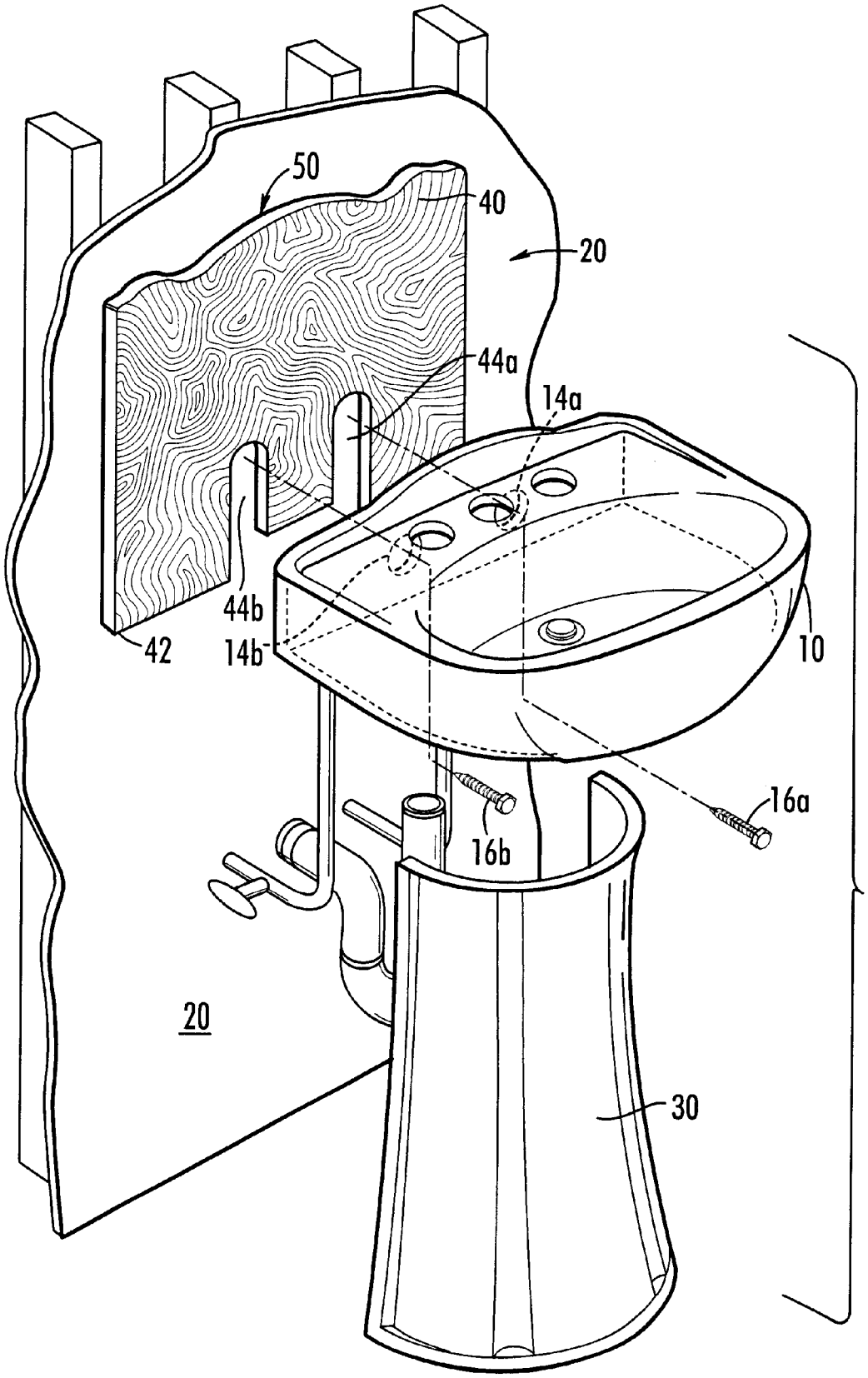
FIG. 3 is an exploded perspective view showing the configuration of the backsplash, and further showing the fastening means by which a pedestal sink is mounted to a wall and the backsplash is secured between the pedestal sink and the wall.

Backsplash (40) is shown in FIG. 3 as preferably a pre-cut planar member having a bottom end (42) and a top end (50). Bottom end (42) contains a plurality of longitudinal cutouts (44) extending perpendicular from bottom edge (42). The distance between cutouts (44) is equivalent to the distance between apertures (14) in planar edge (12) of sink bowl (10). Cutouts (44) allow backsplash (40) to be inserted between vertical wall (20) and planar edge (12) of sink bowl (10) during installation without interference with fastening members (16). Upon installation, a bead of caulking material may be run along the intersection of backsplash (40) and planar edge (12) of sink bowl (10) as is common in the art to further prevent water intrusion behind the pedestal sink assembly.

The backsplash (40) of the present invention is made of a suitable material such as painted or stained wood with a waterproof sealer applied thereto, plastic, porcelain, marble or granite. Depending upon the material used for backsplash (40), cutouts (44) should be of sufficient longitudinal length to prevent rotation of backsplash (40) about its bottom end (42). Backsplash (40) may also be made wider than sink bowl (10). FIG. 3 illustrates a common pedestal sink assembly having two fastening members 16*a* and 16*b* that extend through apertures 14*a* and 14*b*, through cutouts 44*a* and 44*b*, and into vertical wall 20.

Alternative embodiments of the present backsplash invention include any number of colors, finishes, and textures for backsplash (40) that would complement the finish of sink bowl (10). Likewise, top end (50) may be finished with any number of aesthetically pleasing, fanciful designs. Further, backsplash (40) may be fitted with an integrated vanity mirror, soap dish, cup holder, toothbrush holder, medicine cabinet, or other fixtures commonly found in a bathroom environment.

The present invention is shown and described for use on a pedestal sink assembly having a columnar structure or pedestal (30) for support of the sink bowl (10). The present invention is also suitable for use with a console sink having a support structure well known in the art that is different from the columnar structure or pedestal (30) shown herein, and is also suitable for use with a wall basin sink having no support structure whatsoever.

Although various preferred embodiments of the present invention have been described herein in detail, it will be appreciated by those skilled in the art that variations may be made thereto without departing from the spirit of the invention or the scope of the appended claims.

What is claimed is:

1. A device for use against a wall, comprising:

a sink;

means for mounting said sink to a vertical wall; and a backsplash comprising a single member with a top edge, an opposing bottom edge, and a front face, said bottom edge having a plurality of cutouts aligned so as to extend around said mounting means so that said backsplash fits between said sink and said wall when said sink is mounted to said wall with said front face being continuous along substantially the entire width of the sink.

2. The device of claim 1, wherein said sink is a pedestal sink.

3. The device of claim 1, wherein said backsplash has a front surface and an opposing rear surface, and wherein said device further comprises a mirror carried on said front surface.

4. The device of claim 1, wherein said backsplash has a front surface and an opposing rear surface, and wherein said device further comprises a cup holder carried on said front surface.

5. The combination of claim 1, wherein said backsplash has a front surface and an opposing rear surface, and wherein said device further comprises a soap dish is carried on said front surface.

6. The combination of claim 1, wherein said backsplash is made of a material selected from the group consisting of wood, plastic, porcelain, marble and granite.

7. A method for installing a backsplash for use with a sink held to a wall with bolts, said method comprising the steps of:

loosening bolts holding said sink to a wall;

sliding a backsplash between said sink and said wall, said backsplash comprising a single member with cutouts formed therein dimensioned so that said cutouts extend around said bolts, said single member defining a front face; and tightening said bolts until said sink is tight against said backsplash with said front face being continuous along substantially the entire width of the sink.

8. The method of claim 7, further comprising the step of substituting long bolts for said bolts.

9. A method for making a sink, said method comprising the steps of:

forming a sink bowl;

forming a pedestal for supporting said bowl;

forming a backsplash comprising a single member having a front face to fit between said sink and wall with said front face being continuous along substantially the entire width of the sink;

providing means for attaching said sink to said wall; and forming cutouts in said backsplash so that said cutouts can extend around said attaching means.

10. The method as recited in claim 9, wherein said sink, pedestal and said backsplash are made of the same material.

11. The method as recited in claim 9, wherein a mirror is attached to said backsplash.

12. The method as recited in claim 9, wherein a cup holder is attached to said backsplash.

13. The method as recited in claim 9, wherein a soap dish is attached to said backsplash.

* * * * *